US008334642B2

(12) United States Patent
Korenev

(10) Patent No.: US 8,334,642 B2
(45) Date of Patent: Dec. 18, 2012

(54) SPARK PLUG

(75) Inventor: Sergey Korenev, Mundelein, IL (US)

(73) Assignee: Caterpillar Inc., Peoria, IL (US)

( * ) Notice: Subject to any disclaimer, the term of this patent is extended or adjusted under 35 U.S.C. 154(b) by 173 days.

(21) Appl. No.: 12/777,761

(22) Filed: May 11, 2010

(65) Prior Publication Data

US 2011/0279008 A1 Nov. 17, 2011

(51) Int. Cl.
*H01T 13/39* (2006.01)

(52) U.S. Cl. ..... 313/141; 313/118

(58) Field of Classification Search ..... 123/169 R, 123/169 EL, 32, 41, 310; 313/118–145; 445/7

See application file for complete search history.

(56) References Cited

U.S. PATENT DOCUMENTS

| | | | | |
|---|---|---|---|---|
| 3,753,699 | A | 8/1973 | Anderson, Jr. et al. | |
| 4,093,887 | A | 6/1978 | Corbach et al. | |
| 4,983,358 | A | 1/1991 | Hebsur et al. | |
| 5,159,232 | A | 10/1992 | Sato et al. | |
| 5,500,304 | A | 3/1996 | Löffler et al. | |
| 5,510,667 | A | 4/1996 | Löffler et al. | |
| 6,677,698 | B2 | 1/2004 | Labarge et al. | |
| 2007/0114900 | A1 | 5/2007 | Lykowski | |
| 2007/0132354 | A1* | 6/2007 | Scott et al. | 313/141 |
| 2007/0222350 | A1 | 9/2007 | Lykowski | |
| 2007/0252501 | A1* | 11/2007 | Tinwell | 313/130 |
| 2007/0278924 | A1 | 12/2007 | Aisenbrey | |
| 2010/0026159 | A1 | 2/2010 | Ohm et al. | |
| 2011/0198983 | A1* | 8/2011 | Manhardt et al. | 313/252 |

FOREIGN PATENT DOCUMENTS

GB 1389271 A 8/1972

OTHER PUBLICATIONS

Huijbregts, W.M.M. and Brabers, M.J., Oxidation of niobium and of niobium coated with aluminium in steam-air mixtures, Technological University, The Netherlands, Oct. 1965, 12 pages.

Heba, J, Niobium Alloys and High Temperature Applications, An Allegheny Technologies Company, Albany, OR, 17 pages.

* cited by examiner

*Primary Examiner* — Joseph L Williams
*Assistant Examiner* — Fatima Farokhrooz
(74) *Attorney, Agent, or Firm* — Finnegan, Henderson, Farabow, Garrett & Dunner LLP

(57) ABSTRACT

A spark plug may include a first electrode, an insulator positioned radially outside the first electrode, and a housing positioned radially outside the insulator. The spark plug may also include a second electrode electrically coupled to the housing. The second electrode may form a spark gap with the first electrode. The spark plug may further include an ignition electrode coupled to at least one of the first electrode and the second electrode. The ignition electrode may include fibers of Nb—Ti within a matrix material.

19 Claims, 4 Drawing Sheets

SPARK PLUG

TECHNICAL FIELD

The present disclosure relates generally to a spark plug.

BACKGROUND

A spark plug is an electrical device that is used to ignite a fuel (such as, for example, a fuel-air mixture) in an internal combustion engine, by means of an electric spark. Spark plugs have an insulated central electrode which is connected by an insulated wire to an ignition coil, a magneto circuit, or another high voltage source. This central electrode forms a spark gap with a grounded terminal at a distal end of the spark plug. The distal end of the spark plug is positioned in a space including the fuel-air mixture. As a voltage difference develops between the central electrode and ground electrode, the conditions for generating a spark at the spark gap are created. When the voltage difference between the electrodes reaches a critical value, the gases in the spark gap become ionized. The ionized gases conduct electricity and therefore allow energy to flow across the spark gap, thereby creating a spark. Spark plugs usually require a voltage of between 10 to 30 kilovolts or more to create a spark.

With time, burnt fuel or oil (soot) deposits on and around the electrodes. These deposits may hinder the formation of a spark and proper ignition of the fuel-air mixture. At high temperatures, the soot deposits on the spark plug tip burns off, thereby allowing spark formation again. The self-cleaning or self-combusting temperature the spark plug must reach to burn off the soot deposits is about 500 to 600° C. In some applications, the electrode temperature may not reach these temperatures. Additionally, at the high temperatures necessary for soot oxidation, electrode oxidation and other corrosion mechanisms that lead to electrode wear increases. These mechanisms contribute to decreasing the expected lifetime of a spark plug.

U.S. Pat. No. 4,093,887 to Corbach et al. (the '887 patent) discloses a spark plug having a center electrode that is designed to decrease corrosion of copper under the influence of hot combustion gases. The center electrode of the '887 patent includes a cladding made of a corrosion resistant material (such as, a nickel alloy or a material based on chromium or cobalt) surrounding a matrix of copper or a copper alloy having high electrical and thermal conductivity. The matrix material has embedded therein filaments made of a corrosion resistant material (preferably, the same material as the cladding). The matrix material at the sparking tip of the center electrode is etched so that the cladding and the embedded filaments protrude from the electrode surface by about 50 to 500 microns. The corrosion resistant cladding and embedded filaments of the '887 patent are said to reduce corrosion of the electrode matrix material and maintain the spark gap thickness at a fixed level. While the center electrode of the '887 patent may decrease corrosion related wear, the center electrode of the '887 patent does not promote an increased electric field at the electrode tip.

The present disclosure is directed to spark plugs that decrease or overcome the shortcomings discussed above and/or other shortcomings in existing technology.

SUMMARY OF THE INVENTION

In one aspect, a spark plug is disclosed. The spark plug may include a first electrode, an insulator positioned radially outside the first electrode, and a housing positioned radially outside the insulator. The spark plug may also include a second electrode electrically coupled to the housing. The second electrode may form a spark gap with the first electrode. The spark plug may further include an ignition electrode coupled to at least one of the first electrode and the second electrode. The ignition electrode may include fibers of Nb—Ti within a matrix material.

In another aspect, a spark plug is disclosed. The spark plug may include a pair of electrodes forming a cathode and an anode positioned to form a spark gap, and an ignition electrode coupled to the cathode proximate the spark gap. The ignition electrode may include fibers of Nb—Ti. The fibers of Nb—Ti may include between about 52 to 54 percent by weight of niobium and between about 46 percent to 48 percent by weight of titanium.

In yet another aspect, a spark plug is disclosed. The spark plug may include an insulator and a first electrode having a region surrounded by the insulator. The spark plug may also include a housing positioned outside the insulator and a second electrode electrically coupled to the housing and positioned to form a spark gap with the first electrode. The spark plug may also include an ignition electrode coupled to at least one of the first electrode or the second electrode. The ignition electrode may include fibers of Nb—Ti. At least some of the fibers of Nb—Ti may protrude into the spark gap.

DETAILED DESCRIPTION

Figure 1:
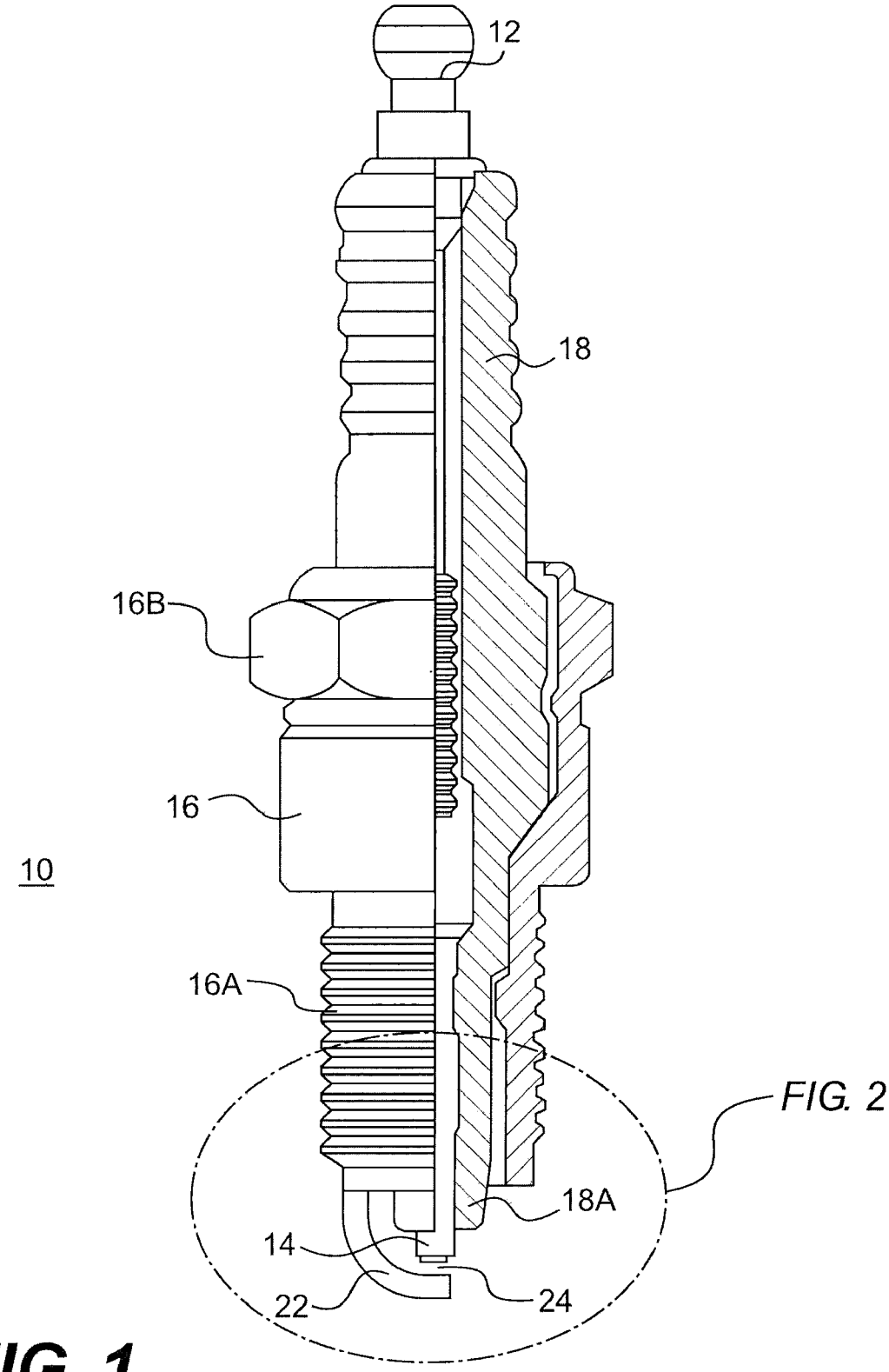
FIG. 1 is a partial sectional view of an exemplary disclosed spark plug.

FIG. 1 illustrates a partial sectional view of an exemplary spark plug 10 of the current disclosure. Spark plug 10 may be used to ignite a fuel-air mixture in any application. In a gasoline engine, spark plug 10 may be used in a combustion chamber of the engine to ignite a fuel-air mixture. Diesel engines may use spark plug 10 in a regeneration system to assist in regeneration of an exhaust treatment component, such as, for example, a Diesel Particulate Filter (DPF) or a Diesel Oxidation Catalyst (DOC). In such a regeneration system application, fuel may be delivered to a burner assembly positioned upstream of the exhaust treatment component, and a spark plug may ignite the fuel mixture to heat the exhaust gases flowing therethrough. These heated exhaust gases may provide the temperature needed for regeneration of the exhaust treatment component. Although spark plug 10 of the current disclosure is not limited to any particular application, in the description below, the application of spark plug 10 in a regeneration application is discussed.

Spark plug 10 includes a terminal 12 electrically connected to a central electrode 14. Central electrode 14 is connected to terminal 12 through an internal wire and commonly a ceramic series resistance to reduce emission of radio frequency (RF) noise due to the sparking. Terminal 12 connects the spark plug 10 to an external high voltage source of an ignition system. The exact terminal construction varies depending on the use of the spark plug. In some embodiments, wires from the high voltage source snap onto terminal 12. In some other embodiments, wires from the high voltage source have spade or other connectors that are fastened onto terminal 12 using a nut. Terminal 12 and the central electrode 14 are electrically separated from an outer housing 16 by an insulator body 18.

Insulator body 18 may be made of any insulating material that can withstand high temperatures. They are typically made from high temperature ceramic materials such as porcelain. However, other high temperature insulating materials such as, for example, fused quartz may also be used to fabricate insulator body 18. The major function of insulator body 18 is to provide mechanical support and electrical insulation for central electrode 14. Insulator body 18 also functions to extend terminal 12 from central electrode 14 so as to make terminal 12 more readily accessible in systems with deeply inaccessible spark plugs. Insulator body 18 extends towards the distal end of spark plug 10 to form an insulating sleeve 18A around the distal end of central electrode 14. During operation, insulating sleeve 18A may be exposed to hot gases within a regeneration system and to high electrical voltages in the central electrode 14. Therefore, insulating sleeve 18A must be configured to withstand high temperatures and high voltages while having a high thermal conductivity. In some embodiments, insulating sleeve 18A may be made of a material different from insulator body 18, such as, for example, sintered aluminum oxide, that is designed to withstand high temperatures and high voltages.

Outer housing 16 surrounds the distal portion of the insulator body 18 and includes features such as screw threads 16A and a bolt 168 to secure spark plug 10 to an internal combustion engine component, such as a burner of the regeneration system. Outer housing 16 is typically made of a metal to withstand the torque of tightening spark plug 10 to the engine component, and to remove heat from insulator body 18 and pass it on to the engine component. It is understood that other securing configurations could be used to secure spark plug 10 to the engine component. The outer housing 16 terminates at a ground electrode 22 at the distal end of spark plug 10. Ground electrode 22 may be made of any conductive material known in the art. In some embodiments, ground electrode 22 may include a high nickel steel. In other embodiments, ground electrode 22 may also be made of the same material as central electrode (such as, copper) or may be provided with a copper core, so as to increase heat conduction. Ground electrode 22 may be positioned near the distal end of central electrode 14 such that a gap 24 exists between the distal end of central electrode 14 and ground electrode 22. During operation, the central electrode 14 may form a cathode and the ground electrode 22 may form an anode. When the voltage difference between the cathode and the anode is high enough to ionize the gases in gap 24, the electrons from the cathode jump gap 24 to the anode (creating a spark) and gets grounded to the engine component through outer housing 16. Although ground electrode 22 is shown as a curved member positioned directly below central electrode 14, this is not a limitation. Any known orientation of ground electrode 22 and gap 24 may be applied with the spark plugs of the current disclosure. In some embodiments, multiple ground electrodes 22 may be positioned around central electrode 14.

Figure 2:
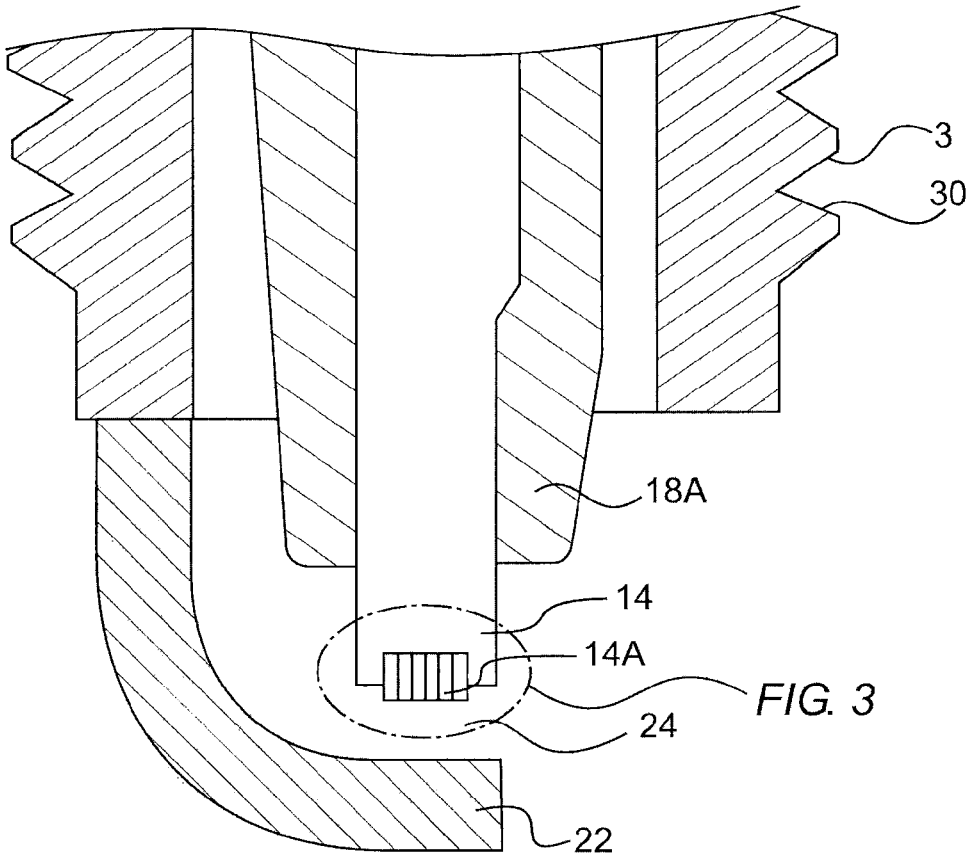
FIG. 2 is a cross-sectional view of the sparking end of the spark plug of FIG. 1.

FIG. 2 is a sectional view of the distal end of spark plug 10, identified in FIG. 1 as the region enclosed by the dashed line. Central electrode 14 may include any material that is typically used as the cathode of a spark plug. Any material that is a good conductor of heat and electricity, and that is capable of operating in the operating environment of spark plug 10, may be used for this purpose. These materials may include copper, alloys of copper, aluminum, alloys of aluminum, nickel alloys, nickel-iron, chromium, chromium alloys, or precious metals. The distal-most end of central electrode 14 may include an ignition electrode 14A.

Ignition electrode 14A may be an insert that is attached to the distal end of central electrode 14. Ignition electrode 14A may be attached to central electrode 14 by any suitable attachment process known in the art. These attachment processes may include welding, brazing, soldering, or any other high temperature attachment process. Ignition electrode 14A protrudes from central electrode 14 into gap 24. In some embodiments however, the surface of ignition electrode 14A may be flush with the surface of central electrode 14. Ignition electrode 14A includes fibers of a material of high current carrying capacity, such as, for example, niobium titanium (Nb—Ti) or niobium tin ($NbSn_3$), positioned within a matrix material. Although ground electrode 22 is shown without an insert in FIG. 2, in some embodiments, ground electrode 22 may also include an attachment similar to ignition electrode 14A. This ground electrode attachment may be structurally similar to ignition electrode 14A or may be different.

Figure 3:
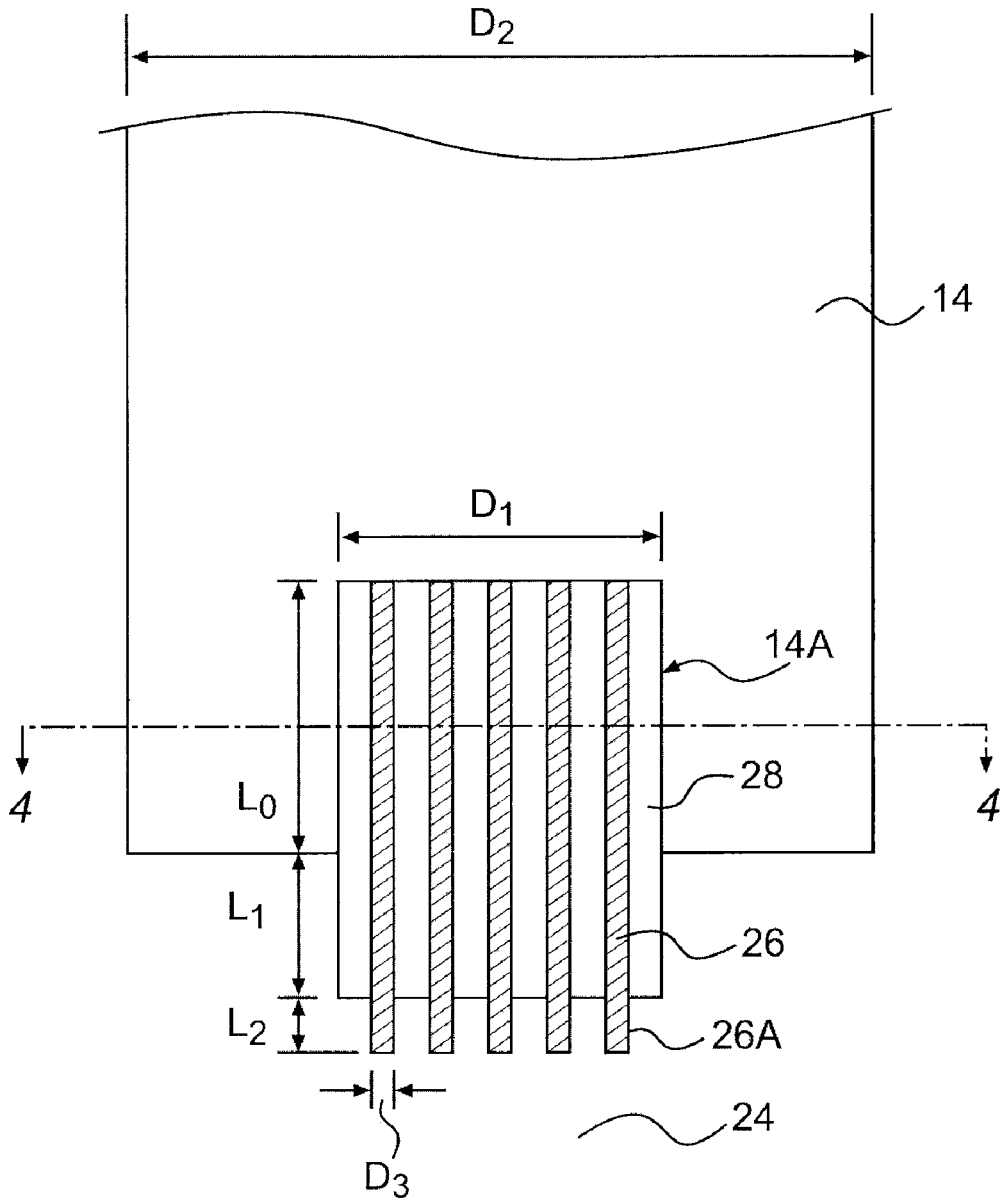
FIG. 3 is a cross-sectional view of the sparking end of an exemplary central electrode of the spark plug of FIG. 1.

FIG. 3 is an illustration of the distal-most region of central electrode 14, identified in FIG. 2 as the region enclosed by the dashed line. In one embodiment, ignition electrode 14A includes fibers 26 of Nb—Ti extending generally longitudinally through a matrix 28. Matrix 28 may include any electrically and thermally conductive material, such as, for example, aluminum, copper, etc. Matrix 28 may provide structural stability to fibers 26. Matrix 28 may be made of the same material as central electrode 14 or may be made of a different material. The material of the Nb—Ti fibers 26 may be a Type-II superconductor comprising an alloy of niobium and titanium. The composition of the superconducting Nb—Ti alloy may include about 53 percent by weight of niobium and about 47 percent by weight of titanium. This composition of niobium and titanium may be a superconductor at 10 Kelvin (−263° C.). Although the Nb—Ti fibers 26 are not used as a superconductor in this application, fibers having this approximate composition have a large current carrying capacity, which may be beneficial in generating a large electric field at the distal end of central electrode 14. Fibers of Nb—Ti having compositions that are slightly different from the superconducting composition may also have sufficient current carrying capacity to be beneficial to this application. For example, the composition of niobium and titanium in the Nb—Ti fibers 26 of this application may also include about 52 to 54 percent by weight of niobium and about 46 percent to 48 percent by weight of titanium. In some embodiments, the fibers 26 may also include small amounts of other elements, such as, for example, hafnium, aluminum, molybdenum, tungsten, and/or silicon (≦about 4%). Presence of these elements may improve the oxidative stability of the Nb—Ti alloy. In some embodiments, atoms of elements such as oxygen may be implanted on the surface of fibers 26 by ion implantation or other techniques to decrease the resistivity of the fibers. In this disclosure, the term Ni—Ti fiber (or a fiber of Ni—Ti) is used broadly to refer to a fiber that is substantially made of niobium and titanium, and to a fiber that includes small amounts of other elements in addition to niobium and titanium. In some embodiments, substantially an entire fiber 26 may consist of the niobium titanium alloy, while in other embodiments, a fiber 26 may include a coating or a shell of the niobium titanium alloy around a core made of a carrier material, such as copper or carbon.

The number of fibers 26, the size of the fibers 26, and the spacing between the fibers 26 may be varied. In an exemplary embodiment, the diameter $D_2$ of central electrode 14 may be between about 1 and 3 mm (1000 to 3000 microns) depending upon the specifications of spark plug 10. The diameter $D_1$ of ignition electrode 14A may also depend upon the application. In some embodiments, commercially available Nb—Ti fibers 26 embedded in a matrix material may be used as ignition electrode 14A. In these embodiments, diameter $D_1$ may include the size of the commercially available fiber matrix combination. In some embodiments, diameter $D_1$ of ignition electrode 14A may be between about 0.3 and 2 mm (300 to 2000 microns), and the diameter $D_3$ of a Nb—Ti fiber 26 may be between about 1 and 20 microns. In preferred embodiments, the diameter $D_3$ of a Nb—Ti fiber 26 may be between 1 and 10 microns, and in more preferred embodiments, this diameter may vary between 3 and 7 microns. In general, diameter $D_3$ may depend on the sizes of commercially available Nb—Ti fibers. In some embodiments, diameter $D_3$ may depend upon the current density of the fiber 26. For instance, in these embodiments, the diameter of the fibers 26 may be chosen so that the maximum current density through the fibers 26 during operation of spark plug 10 is below an acceptable limit. Although the central electrode 14, the ignition electrode 14A, and the Nb—Ti fibers 26 are described as having a diameter, their cross-sectional shape may be other than circular and have width sized as disclosed above. In general, some or all of the central electrode 14, ignition electrode 14A, and fibers 26 may include any cross-sectional shape (such as, for example, rectangular, square, or any other multi-sided shape). Although FIG. 3 illustrates all the fibers 26 as extending through ignition electrode 14A linearly in a consistent manner, this is not a limitation. In general, the fibers 26 may extend through ignition electrode 14A in any manner. For instance, in some embodiments, the fibers 26 may be helically disposed about a central axis of the ignition electrode, while in other embodiments, some fibers 26 may extend linearly while some fibers 26 may twist around other fibers 26.

At the distal-most end of ignition electrode 14A, some or all of fibers 26 protrude into gap 24 to create a protruding region 26A. Matrix 28 at the distal-most end of ignition electrode 14A may be etched using a chemical etchant (or by other suitable method) to expose a length $L_2$ of fibers 26 at the distal-most end that protrudes into gap 24 like the bristles of a brush. A length $L_0$ of ignition electrode 14A within central electrode 14, a length $L_1$ of matrix 28 of the ignition electrode 14A protruding into gap 24, and a length $L_2$ of the protruding region 26A may vary with application. In one embodiment, the length $L_0$ of ignition electrode 14A may be between about 5 and 10 mm (5000 to 10000 microns). Such a length $L_0$ provides interfacing surfaces of central electrode 14 and ignition electrode 14A to form the desired electric field. In some embodiments, length $L_1$ of matrix 28 of the ignition electrode 14A may be between about 0 and 5 mm (0 to 5000 microns), and the length $L_2$ of protruding region 26A may be between about 0.9 and 10 mm (900 to 10000 microns). At greater lengths of $L_2$, repulsive forces between adjacent fibers 26, caused due to Lorentz forces, may cause adjacent fibers 26 to bend away from each other, detrimentally affecting the sparks generated in gap 24. Lorentz forces are the forces generated in the fibers 26 due to induced electromagnetic fields caused by large electric field therein. In preferred embodiments, length $L_2$ may vary between 1 and 7 mm, and in more preferred embodiments, length $L_2$ may vary between 3 and 7 mm. Over time, corrosive effects of the environment and the electric field may cause a reduction in length $L_2$ of protruding region 26A. Therefore, choice of a smaller length for $L_2$ may negatively affect the expected lifetime of spark plug 10.

Figure 4:
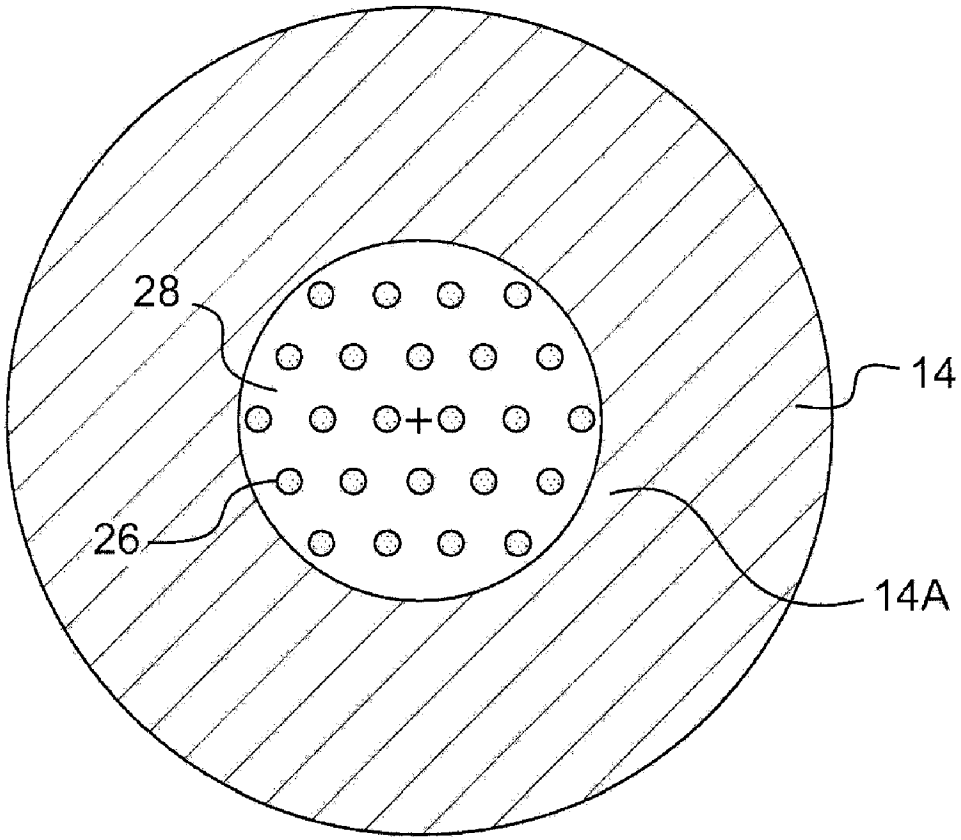
FIG. 4 is a cross-sectional view of the central electrode of FIG. 3.

FIG. 4 illustrates a cross-sectional view of central electrode 14 through the section marked 4-4 in FIG. 3. As indicated earlier, although the central electrode 14, the ignition electrode 14A, and fibers 26 are illustrated as being circular, some or all of them may have other shapes. In some embodiments, fibers 26 may be substantially evenly distributed across matrix 28 of ignition electrode 14A. However, in some embodiments, clusters of fibers 26 may be clumped together into fiber regions of ignition electrode 14A. In these embodiments, the fibers 26 may be unevenly distributed across central electrode 14A. It is also contemplated that, in some embodiments, matrix 18 may be substantially or entirely eliminated. In these embodiments, ignition electrode 14A may include a cluster of closely spaced fibers 26 extending longitudinally through central electrode 14A.

Industrial Applicability

A spark plug of the current disclosure may be beneficial for any application where spark plugs are currently used or may be used. For example, as discussed above, the disclosed spark plug may be used in a combustion chamber of a gasoline engine or in a regeneration system of a diesel engine.

To illustrate some of the features of a spark plug of the current disclosure, an exemplary application of a spark plug attached to a burner of a regeneration system is disclosed. Terminal 12 of spark plug 10 is electrically coupled to the high voltage generated by an ignition coil or a magneto. As the electrons flow from the coil, a voltage difference develops between the central electrode 14 and ground electrode 22 because the fuel-air mixture in gap 24, between these electrodes, prevents current flow therethrough. As the voltage difference exceeds the dielectric strength of the gases, the gases become ionized, and electrons from ignition electrode 14A jump across gap 24, creating a spark across the gap.

In ignition electrode 14A, electrons are emitted where the electrical field strength is the greatest. The electric field strength is the greatest where the radius of curvature of the surface is the smallest. That is, electrons are discharged from sharp points or edges of ignition electrode 14A rather than flat surfaces. The exposed fibers 26 at the distal-most end of ignition electrode 14A increases the number of sharp corners and edges available for the emission of electrons, thereby increasing the sparks across gap 24. The large current carrying capacity of Nb—Ti further increases the sparks across the gap. During use, the exposed surface of matrix 28 of the ignition electrode 14A oxidizes and creates an oxide shell on the electrode surface. This oxide shell acts as a barrier against secondary emission of electrons from the exposed surface of matrix 28. Preventing the secondary emission of electrons from the matrix surface concentrates the electric field at the distal end of fibers 26, and improves the stability of the arcs generated therefrom. During continued use, soot gets deposited on the exposed surfaces of the ignition electrode 14A, including the exposed surfaces of fibers 26 and matrix 28. The intensity of the sparks generated by the Nb—Ti fibers 26 burn the soot off of the exposed surfaces of fiber 26. The soot deposited on the matrix 28 surface adds to the oxide shell and helps to further prevent secondary emission of electrons from matrix 28.

In the spark plugs of the current disclosure, the current density at the distal end of the fibers 26 may be high due to the material of the fibers. This high current density may increase the intensity of the spark generated across the spark plug gap. The increased intensity of the sparks may assist in igniting a fuel-air mixture in the gap. The increased intensity of the sparks may also increase the temperature of the electrode tip above that necessary to burn the soot deposited thereon. The geometry at the distal end of the ignition electrode, where fibers 26 protrude into gap 24, may also increase the electric field enhancement at the electrode tip. Preliminary evaluations indicate that spark plugs of the current disclosure provides an electric field that is about 2 to 8 times higher than that of an electrode without the fibers. This increased electric field may decrease the critical voltage needed to create a spark across the spark gap. This increased electric field may also allow a spark to be created across a larger gap, and therefore may enable increasing the thickness of the spark gap.

It will be apparent to those skilled in the art that various modifications and variations can be made to the disclosed spark plug. Other embodiments will be apparent to those skilled in the art from consideration of the specification and practice of the disclosed spark plug. It is intended that the specification and examples be considered as exemplary only, with a true scope being indicated by the following claims and their equivalents.

What is claimed is:

1. A spark plug, comprising:

a first electrode;

an insulator positioned radially outside the first electrode;

a housing positioned radially outside the insulator;

a second electrode electrically coupled to the housing and forming a spark gap with the first electrode; and an ignition electrode coupled to at least one of the first electrode and the second electrode, the ignition electrode including fibers of Nb—Ti within a matrix material, the fibers of Nb—Ti including between about 52 to 54 percent by weight of niobium and between about 46 percent to 48 percent by weight of titanium.

2. The spark plug of claim 1, wherein at least some of the Nb—Ti fibers protrude from the matrix material into the spark gap.

3. The spark plug of claim 1, wherein the matrix material includes one of copper and aluminum.

4. The spark plug of claim 1, wherein the ignition electrode is coupled to the first electrode.

5. The spark plug of claim 1, wherein the fibers of Nb—Ti further includes at least one of silicon or aluminum.

6. The spark plug of claim 1, wherein the fibers of Nb—Ti includes about 53 percent by weight of niobium and about 47 percent by weight of titanium.

7. The spark plug of claim 1, wherein a diameter of the ignition electrode is between about 0.3 to 2 mm.

8. The spark plug of claim 1, wherein a diameter of the first electrode is between about 1 to 3 mm.

9. The spark plug of claim 1, wherein alength of the fibers that protrude into the spark gap is between about 0.9 to 10 mm.

10. The spark plug of claim 1, wherein the fibers of Nb—Ti extend generally along a longitudinal axis of the spark plug.

11. The spark plug of claim 2, wherein a diameter of a Nb—Ti fiber is between about 1 to 20 microns.

12. The spark plug of claim 2, wherein at least some of the Nb—Ti fibers protrude by a length of between about 0.9 and 10 mm into the spark gap.

13. A spark plug comprising:

a pair of electrodes forming a cathode and an anode of the spark plug, the electrodes being positioned to form a spark gap; and an ignition electrode coupled to the cathode proximate the spark gap, the ignition electrode including fibers of Nb—Ti, wherein the fibers of Nb—Ti includes between about 52 to 54 percent by weight of niobium and between about 46 percent to 48 percent by weight of titanium.

14. The spark plug of claim 13, wherein a diameter of a Nb—Ti fiber is between about 1 to 20 microns and at least some of the Nb—Ti fibers protrude by a length of between about 0.9 and 10 mm into the spark gap.

15. The spark plug of claim 13, wherein the fibers of Nb—Ti includes about 53 percent by weight of niobium and about 47 percent by weight of titanium.

16. The spark plug of claim 13, wherein the fibers of Nb—Ti extend generally along a longitudinal axis of the spark plug.

17. A spark plug comprising:

an insulator;

a first electrode having a region surrounded by the insulator;

a housing positioned outside the insulator;

a second electrode electrically coupled to the housing and positioned to form a spark gap with the central electrode; and an ignition electrode coupled to at least one of the first electrode or the second electrode, the ignition electrode having fibers of Nb—Ti, wherein at least some of the fibers of Nb—Ti protrude into the spark gap.

18. The spark plug of claim 17, wherein a diameter of a Nb—Ti fiber is between about 1 to 20 microns, a diameter of the ignition electrode is between about 0.3 to 2 mm, and at least some of the Nb—Ti fibers protrude by a length of between about 0.9 to 10 mm into the spark gap.

19. The spark plug of claim 17, wherein the fibers of Nb—Ti includes between about 52 to 54 percent by weight of niobium and between about 46 percent to 48 percent by weight of titanium.

* * * * *

UNITED STATES PATENT AND TRADEMARK OFFICE

CERTIFICATE OF CORRECTION

PATENT NO. : 8,334,642 B2
APPLICATION NO. : 12/777761
DATED : December 18, 2012
INVENTOR(S) : Sergey Korenev It is certified that error appears in the above-identified patent and that said Letters Patent is hereby corrected as shown below:

In the Specification

Column 3, line 29, delete "168" and insert -- 16B --.

Column 6, line 13, delete "Industrial Applicability" and insert -- INDUSTRIAL APPLICABILITY --.

In the Claims

Column 7, line 44, in Claim 9, delete "alength" and insert -- a length --.

Signed and Sealed this
Twenty-fifth Day of August, 2015

Michelle K. Lee

Michelle K. Lee
*Director of the United States Patent and Trademark Office*